US007780478B2

(12) United States Patent
Tang et al.

(10) Patent No.: US 7,780,478 B2
(45) Date of Patent: Aug. 24, 2010

(54) APPARATUS AND METHODS FOR CONNECTING TWO ELECTRICAL DEVICES TOGETHER

(75) Inventors: John Tang, San Carlos, CA (US); Robert Sean Murphy, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 74 days.

(21) Appl. No.: 11/823,925

(22) Filed: Jun. 28, 2007

(65) Prior Publication Data

US 2009/0004923 A1 Jan. 1, 2009

(51) Int. Cl.
*H01R 24/04* (2006.01)

(52) U.S. Cl. ..... 439/668

(58) Field of Classification Search ..... 439/668, 439/500, 879, 585, 882, 63, 488
See application file for complete search history.

(56) References Cited

U.S. PATENT DOCUMENTS 6,644,993 B2 * 11/2003 Victor ..... 439/175
6,705,900 B2 * 3/2004 Sommer et al. ..... 439/668
7,056,157 B2 * 6/2006 Herring et al. ..... 439/680
7,160,156 B2 * 1/2007 Holliday ..... 439/879
7,361,058 B1 * 4/2008 Lien et al. ..... 439/638
7,402,083 B2 * 7/2008 Kast et al. ..... 439/660
2005/0159041 A1 * 7/2005 Holliday ..... 439/500

* cited by examiner

*Primary Examiner*—Jean F Duverne
(74) *Attorney, Agent, or Firm*—Kramer Levin Naftalis & Frankel LLP

(57) ABSTRACT

Methods and apparatus are provided for connecting together two audio components that have different size connectors and/or a different configuration of electrical contacts between them. In one embodiment of the present invention, an audio adaptor is designed having an audio plug of one size to mate with a first electrical device, such as an integrated media-phone such as the iPhone™, and an audio jack having a different size to mate with a second electrical device, such as a conventional cell phone headset having a single earpiece. In that instance, the plug would be a four-prong, 3.5 millimeter stereo device, while the jack would be a three-prong, 2.5 millimeter monaural device. The adaptor includes circuitry that takes one audio channel (i.e., the left or right channel), and couples it to the audio input on the monaural jack.

44 Claims, 6 Drawing Sheets

APPARATUS AND METHODS FOR CONNECTING TWO ELECTRICAL DEVICES TOGETHER

BACKGROUND OF THE INVENTION

This relates to electronic devices and more particularly to methods and apparatus for connecting together two electrical devices in which the mating connectors on each device are of different sizes.

Portable electronic devices, such as wireless and cellular telephones, digital media players (e.g., music players and video players), and hybrid devices that combine telephone and media playing functionality are known. These devices are typically configured to provide communications to a user in one or more modes. In some of those modes, the communications can be wireless, such as via a cellular telephone network, a Wi-Fi network, or Bluetooth communications. In those instances, the user interacts with another device or location to receive information in the form of audio, video or both.

The transmission of the received audio signals to the user (from the person on the other end of the call), as well as the receipt and transmission of the audio signals from the user that are captured by the phone's microphone can be accomplished wirelessly or through the use of a wired device. While wireless communication headsets often communicate with the cellphone via the Bluetooth standard, the present invention does not address such technology.

The present invention addresses problems which exist through the use of wired connections. There are great number of accessories that are available for portable electronic devices, and particularly for hybrid devices which combine the functions of a cellular telephone with one or more additional functions, such as the storing and playback of music files. In most instances, the portable electronic devices have a connector that is one of a limited number of standard sizes for audio communications. For example, many cellular telephones have an audio jack that accepts 2.5 millimeter plugs, while many multimedia devices, such as iPods and DVD players, have an audio jack that accepts 3.5 millimeter plugs. One potential reason for this variation is that conventional audio headsets typically include a microphone signal, a monaural audio signal and a ground signal. As such, those connectors often are limited to three contacts.

The 3.5 millimeter connectors, on the other hand, rarely, if ever, include a microphone input, and instead, are often capable of providing stereo audio signals to the user. These devices include the family of products knows as "ear buds," which are small devices placed in the external cavity of a user's ears, as well as full-sized sets of headphones, such as the Bose™ QuietComfort™ headphones.

One problem with this scenario, occurs when a user wants to use a device having one sized jack with another device having a different sized-plug. In addition to the size difference, there are often problems with a mismatching of signals between the two devices. This leaves the user with few, if any, options.

This problem becomes even larger with the further development of multi-use, hybrid devices, such as Apple's iPhone™, which includes a 3.5 millimeter jack for mating with devices such as the Bose™ QuietComfort™ headphones. For example, in the instance where a user is using the iPhone™ to watch a movie, the user may want to use high quality, noise cancellation headphones to try and maximize his/her experience. In another instance, the user may want to place a call using a wired headset, which is typically a monaural 2.5 millimeter device.

Another type of electronic device where the size mismatch occurs is in the use of electronic equipment to aid the deaf in telephonic communications. These devices are often referred to as "TTY" devices. One such device is, for example, the Ameriphone Q90D Digital Cell Phone Compatible Combination TTY/VCO device. The Q90D enables a hearing-impaired individual to make cellular telephone calls by converting the audio signals to written form and displaying them to the user. These devices, however, uniformly require the use of a 2.5 millimeter plug. Thus, it would not be possible to use such devices with portable hybrid electronic devices having other sized connectors.

Accordingly, what is needed are methods and apparatus for providing users with the ability to use portable electronic devices having different sized connectors. In addition, it is also a need to provide users with the ability to use together portable electronic devices which offer the user otherwise incompatible electronic signal interfaces.

SUMMARY OF THE INVENTION

Methods and apparatus are provided for connecting together two audio components that have different size connectors and which may also have a different configuration of electrical contacts between them.

In one embodiment, the methods and apparatus of the present invention, an audio adaptor is designed with an audio plug of one size to mate with a first electrical device, such as an integrated media device such as Apple's iPhone™, and an audio jack having a different size to mate with a second electrical device, such as a conventional, monaural cell phone headset having a single earpiece. In that instance, the plug would be a four-prong, 3.5 millimeter stereo device, while the jack would be a three-prong, 2.5 millimeter monaural device. In this instance, the adaptor would include circuitry to take one audio channel (i.e., the left or right channel), and couple it to the audio input on the monaural jack.

The mismatch of physical characteristics can be overcome through the use of an audio adaptor unit that is constructed from a plug having one dimension, a jack having the other dimension and a coupler that physically and electrically connects the plug and jack together to form a single unit.

In accordance with the principles of the present invention, it may be advantageous to provide a coupler having interconnection circuitry that connects the prongs, for example the jack, to one or more of the prongs of the plug. In one instance, the plug may be a four-prong plug where the four prongs provide a left channel audio signal, a right channel audio signal, a microphone signal and a ground signal, while the jack may be a three-prong jack having a single monaural audio signal, a microphone signal and a ground signal.

The interconnection circuitry may solely be wires that are used to connect the selected prongs on the plug to the prongs on the jack (such as where only one of the left and right channel will be connected to the audio prong on the jack). Wires, however, may result in a larger coupler than is otherwise possible, in addition to the additional labor requirements that are likely to be necessary during the assembly of the device.

One alternative to using wires is, in accordance with the present invention, the use of metal tabs instead of wires. The metal tabs could be soldered or otherwise attached to the appropriate prongs on the plug and on the jack. Then, in an additional process step, the tabs could be attached to each other (once again, through soldering, or some other form of connection). In addition, because of the overall stiffness of the metal tabs, it would be easier to manufacture such a device since the tabs could be easily aligned without an assembler having to hold them in place as might be required when using wires. A still further advantage of using metal tabs is that they can be manufactured to have a specific orientation which can help account for the differences between the different sized connector components.

Thus, in this embodiment, a 3.5 millimeter stereo plug having a microphone input can be coupled together with a 2.5 millimeter monaural jack such that a single earpiece microphone headset can be used on a stereo device having a 3.5 millimeter jack. The audio adaptor could, if metal tabs are used for the interconnection circuitry, be a relatively small and compact device, which may make it easier to use.

BRIEF DESCRIPTION OF THE DRAWINGS

The above and other features of the present invention, its nature and various advantages will become more apparent upon consideration of the following detailed description, taken in conjunction with the accompanying drawings, in which like reference characters refer to like parts throughout, and in which.

DETAILED DESCRIPTION OF THE INVENTION

Figure 1:
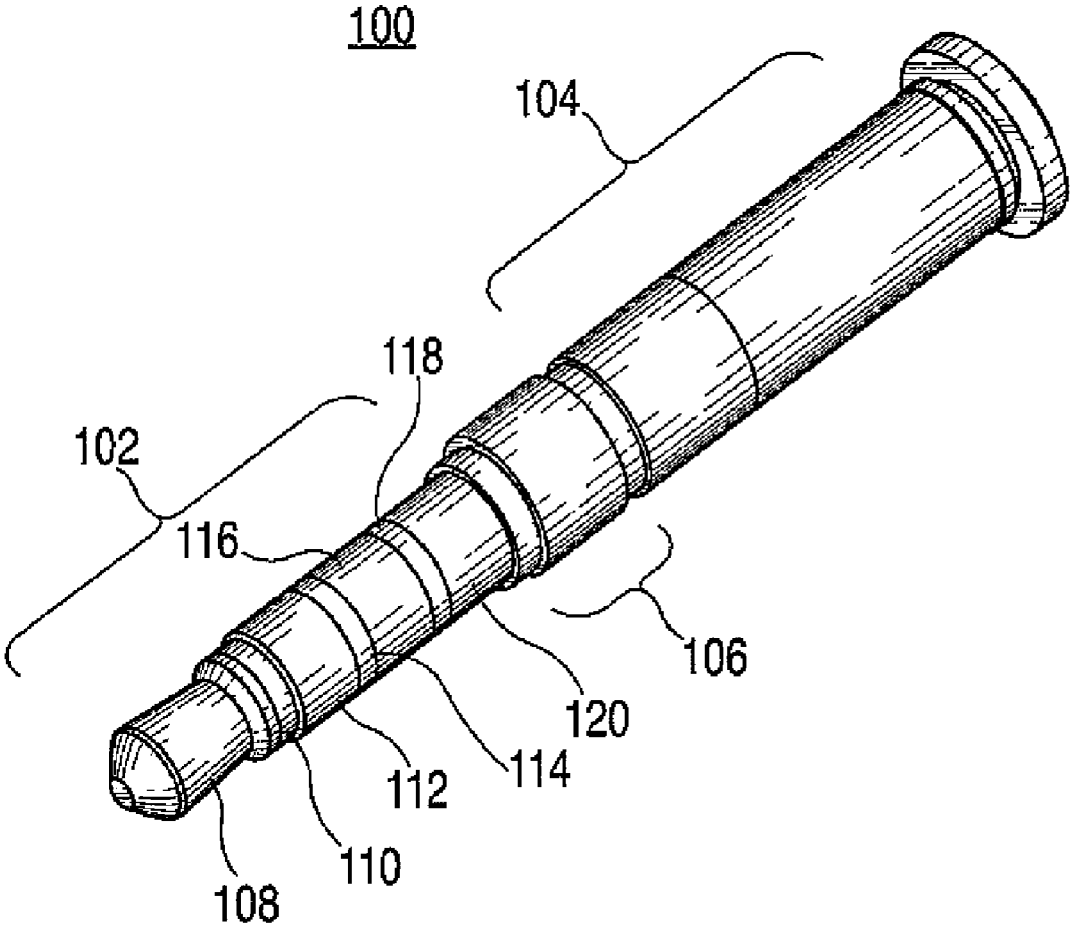
FIG. 1 is a three dimensional, perspective view, schematic diagram of an audio adaptor constructed in accordance with an embodiment of the present invention.

FIG. 1 shows a three dimensional, perspective view, schematic diagram of an illustrative audio adaptor device 100, which is constructed in accordance with the principles of the present invention. Audio adaptor 100 may include plug 102, jack 104 and coupler 106. In one embodiment of the present invention, plug 102 is a 3.5 millimeter plug formed from multiple pieces of brass, a copper alloy or other suitable electrically conductive material (generally referred to hereinafter as "metal"), which alternate with pieces of insulating material.

Figure 2:
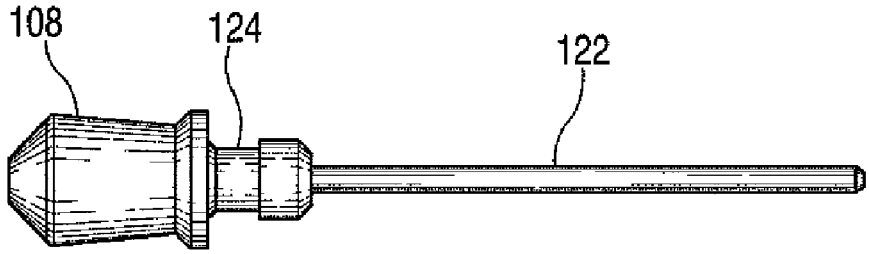
FIG. 2 is a side view schematic diagram of a portion of a connector plug that is used in accordance with the principles of the present invention.
Figure 3:
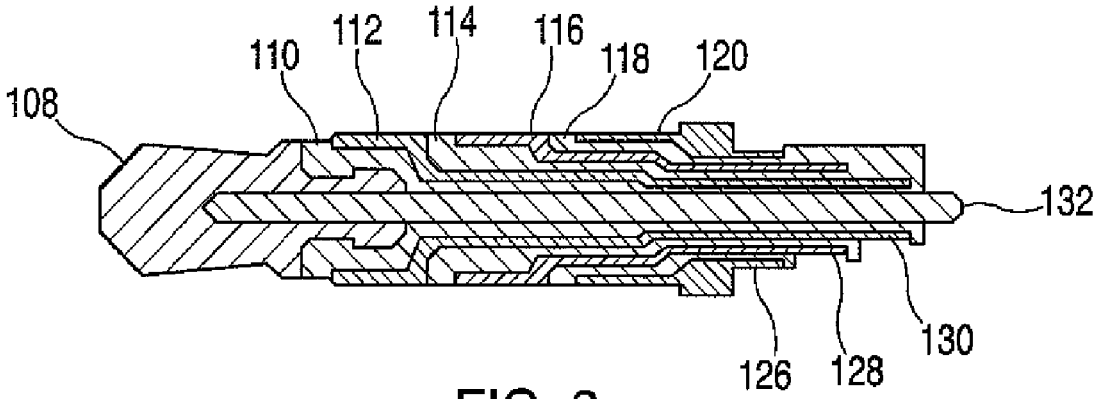
FIG. 3 is a side view sectional diagram of a connector plug that is used in accordance with the principles of the present invention.

As shown in FIGS. 1, 2 and 3, plug 102, includes a conductive metal center post 108, insulator 110, conductive metal ring 112, insulator 114, conductive metal ring 116, insulator 118 and conductive metal ring 120. While several of these components are described as "rings" that refers to what a user can view in the fully assembled form of audio adaptor 100. In actuality, as can been seen more clearly in the section view of FIG. 3, plug 102 includes a center post that extends from both ends of plug 102.

All of the additional components that are used to construct plug 102 are placed and/or fabricated on post portion 122 of center post 108. For example, during the assembly process, insulating ring 110 can be injection molded in place on post portion 122. If the process were performed in that manner, ring 112 (and its prong) would be placed on post portion 122, and then insulating ring portion 114 could be applied. The remaining sub-components can then be used to fabricate the complete plug. Alternatively, each of the "rings", as well as center post portion 122 could be placed in an injection mold, and all of the insulating surfaces could be injection molded at one time. It should be noted that while the insulating rings are described as individual sub-components (i.e., insulating rings 110, 114 and 118), that is only how the "rings" would look to a user after the assembly is complete. All of the "insulating rings" can be formed at one time from one insulating material through, for example, an injection molding process, such that all of the "insulating rings" are, in actuality, a single subassembly.

Once the sub-assembly is complete, each of the four contact portions of plug 102 (i.e., the conductive metal rings) has a corresponding prong portion that can be used to electrically connect plug 102 to jack 104. For example, center post 108 has a prong as shown by reference numeral 132, while conductive ring 112 has its prong at location 130. Similarly, conductive ring 116 has its prong at location 128 and conductive ring 120 has its prong at location 126.

Figure 4:
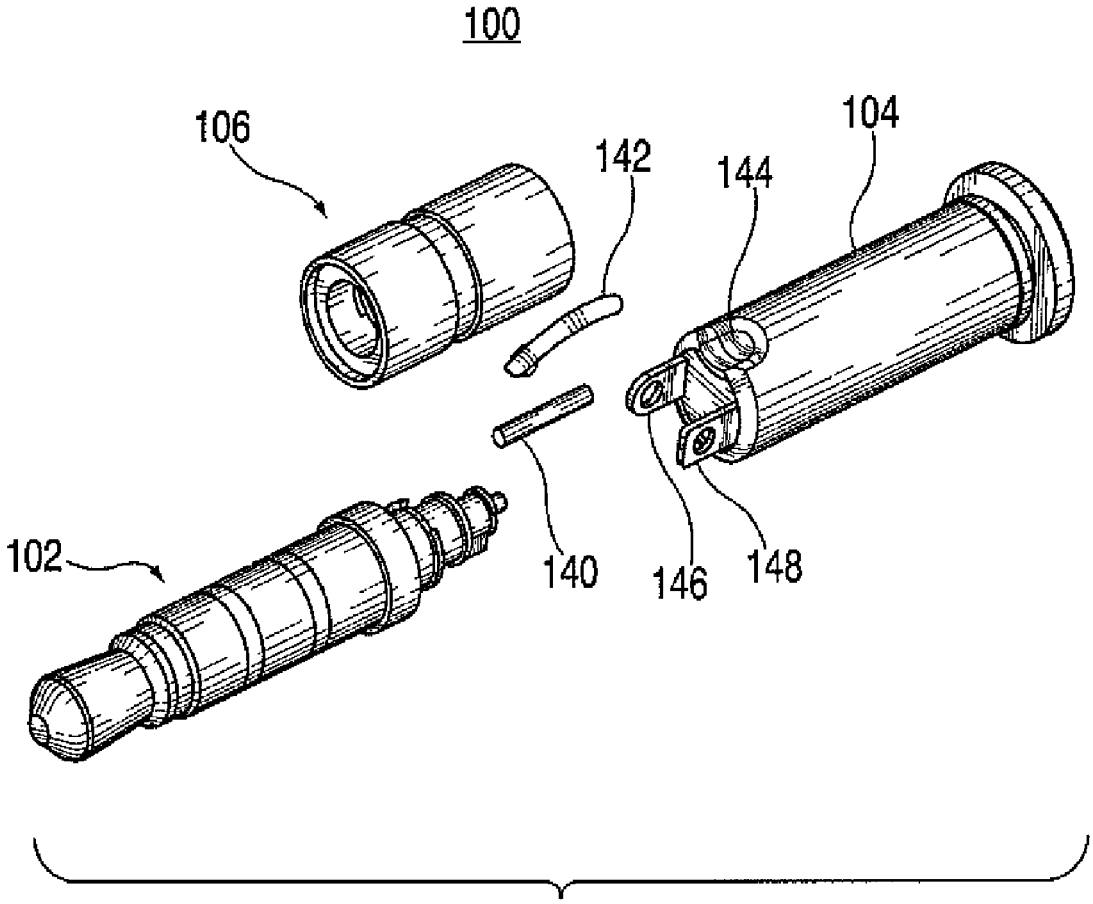
FIG. 4 is an exploded, three dimensional, perspective view, schematic drawing of an audio adaptor constructed in accordance with an embodiment of the present invention.

FIG. 4 shows an exploded, three dimensional, perspective view, schematic drawing of audio adaptor 100. As stated above, audio adaptor 100 includes plug 102, jack 104 and coupler 106. FIG. 4 also shows wires 140 and 142 that may be used to electrically connect prongs from plug 102 to prongs from jack 104. In this instance, wires 140 and 142 would operate as coupling circuitry, along with an additional wire which is not shown.

Wire 142 can be connected to prong 144 of jack 104 in such manner as to be physically and electrically connected, such as by soldering them together. Wire 140 can be connected in a similar manner to prong 146, and the additional wire (not shown), can be connected to prong 148. This can provide a way for each of the three contacts in jack 104 to have an electrical connection to plug 102.

It also may be advantageous to use metal tabs as conductors instead of wires. They can provide a number of benefits. For example, metal tabs can take up significantly less space than wires (all of the "connection circuitry" must fit within the interior of coupler 106. In addition, that manufacturing process may be more efficient through the use of metal tabs instead of wires, because the tabs can be formed to substantially retain a specific orientation within audio adaptor 100 during the assembly process. It also may be advantageous to use a combination of tabs and wire, such as by connecting a tab to prong 144 and wires to prongs 146 and 148.

As shown in FIG. 4, the assembly process for audio adaptor 100 would include prefabricating plug 102 and jack 104, connecting wires or tabs to the prongs of each device and placing the sub-assembly in an injection mold so that coupler 106 can be injection molded into place to physically combine plug 102 and jack 104 into a single physical unit 100. One advantage of this approach is that the connection circuitry, whether it be wires or metal tabs, would be encapsulated by the injection molded materials, which would help insure that the connections remain in place throughout the life of audio adaptor 104.

Figure 5:
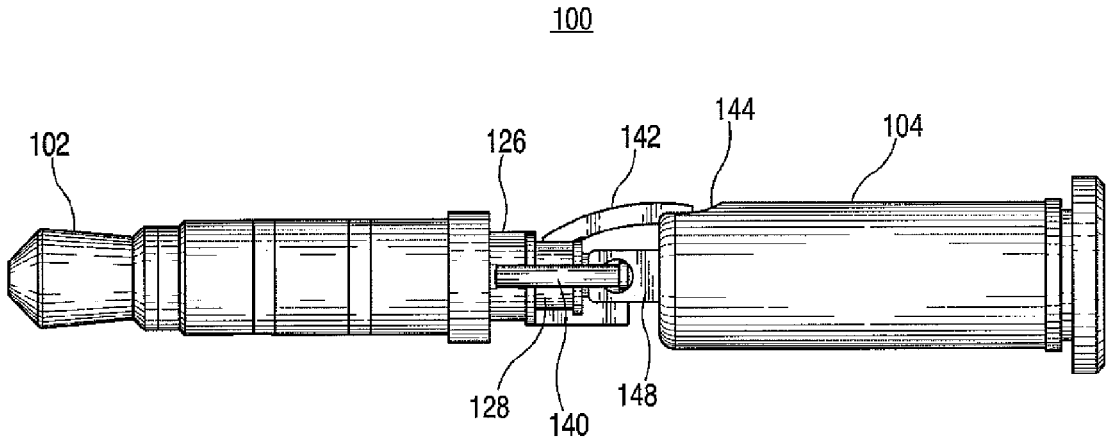
FIG. 5 is a side view schematic diagram of a connector plug and connector jack that are used in accordance with the principles of the present invention.

FIG. 5 shows a side view of audio adaptor 100 prior to the injection molding process (or other, similar process) that forms coupler 106. As shown in FIG. 5, wire 142 is connected (both physically and electrically) to jack 104 via prong 144. In addition, the other end of wire 142 is connected to prong 128 of plug 102. Similarly, wire 140 is shown as being connected from prong 148 on jack 104 to prong 126 on plug 102. Moreover, as described above, "wires" 140 and 142 may easily be replaced as metal tabs.

Figure 6:
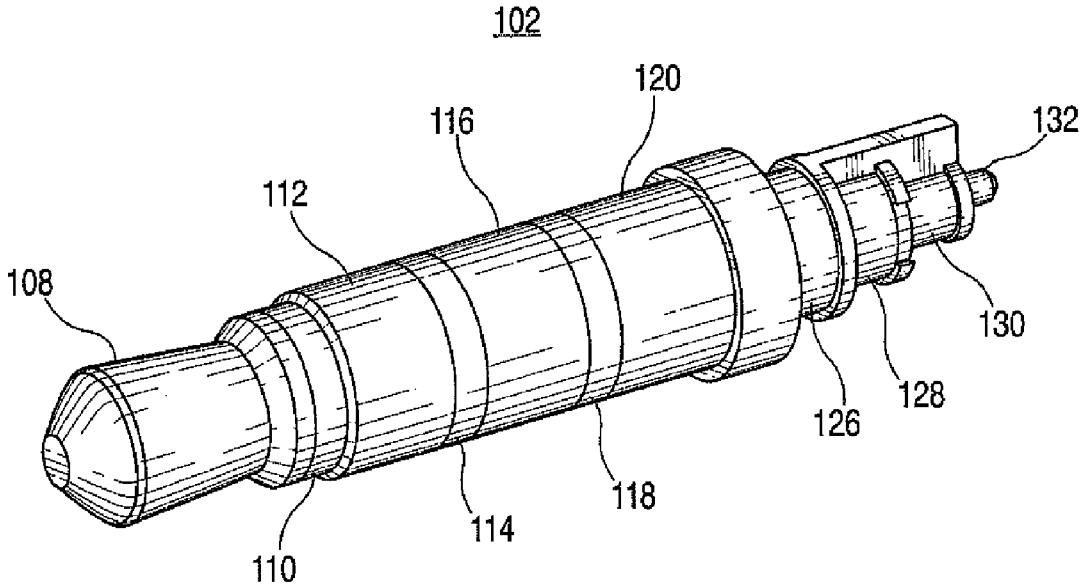
FIG. 6 is a three dimensional, perspective view, schematic diagram of a plug, which is a portion of an audio adaptor constructed in accordance with the principles the present invention.

FIG. 6 shows a three dimensional perspective view of fully-assembled plug 102. As previously described, plug 102 includes various sub-components, such as conductive surfaces 108, 112, 116 and 120, insulating surfaces 110, 114 and 118, and four prongs 126, 128, 130 and 132. FIG. 6 shows plug 102 as it would exist prior to inclusion audio adaptor 100, such that the conductive surfaces and the insulating surfaces all appear as rings. However, as previously described, the conductive surfaces all run along paths within plug 102 to the prongs.

Figure 7:
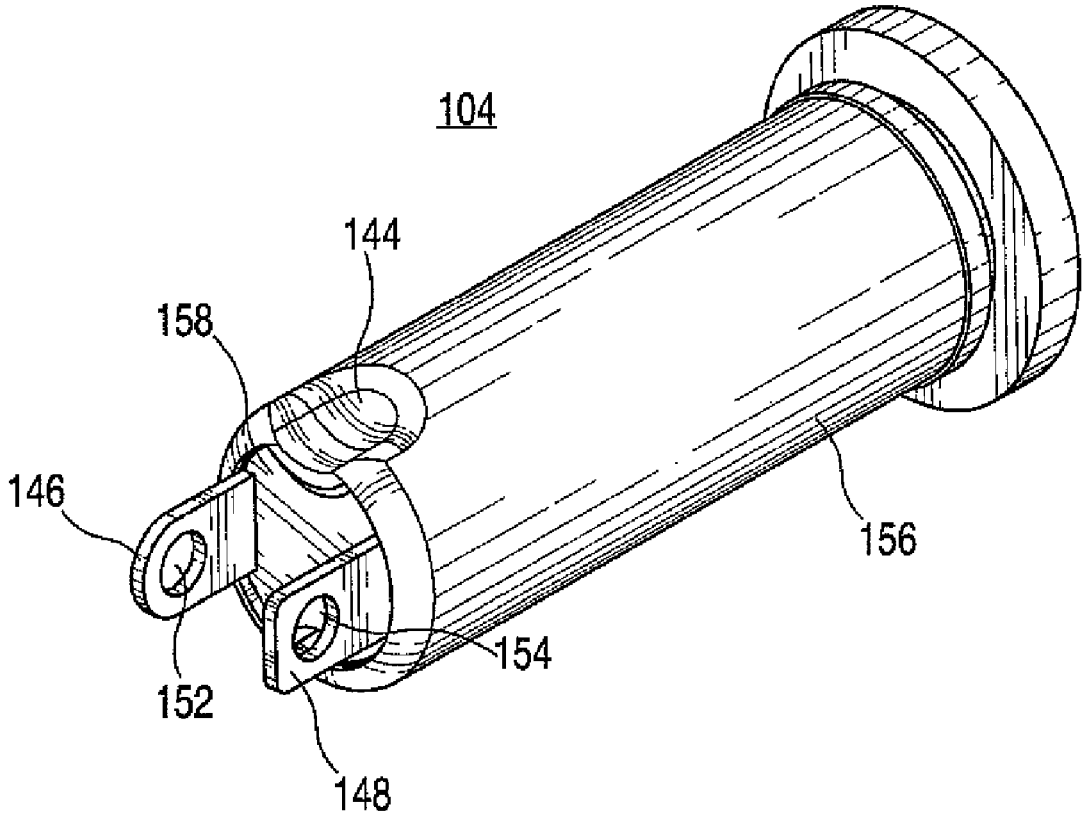
FIG. 7 is a three dimensional, perspective view, schematic diagram of a jack, which is a portion of an audio adaptor constructed in accordance with the principles the present invention.

FIG. 7 shows a three dimensional perspective view of fully-assembled jack 104. As previously described, jack 104 includes various sub-components, such as prongs 144, 146 and 148, and insulated body portions 156 and 158. The connection circuitry can be physically attached to the prongs located on jack 104 by, for example, soldering them in place. For additional reliability and performance, particularly if wires are used as the connection circuitry, the wires may be secured to holes 152 and 154, as appropriate, to insure that good contact exists between the wire and the prong, as well as to improve the likelihood that the wires will remain in place throughout the operational life of audio adaptor 100.

In a practical example of the present invention, assume that a user wishes to use an Apple iPhone with the Ameriphone Q90D TTY device previously described. The iPhone has a 3.5 millimeter stereo jack, which includes 4 contact elements (left audio, right audio, microphone and ground). The Q90D has a 2.5 millimeter monaural jack (that complies with TSB-121, an industry standard). In order to use the two products together, the user needs a solution that addresses the physical differences between devices, as well as the different electrical configurations. The use of audio adaptor 100, however, provides just that solution, by converting the dimensions of the cable from the Q90D to 3.5 millimeters, and by connecting only one of the audio contacts in the iPhone to the audio line on the Q90D.

The present invention can also be used to provide a solution to the previously described "electrical mismatching" in situations where the plug and the jack are the same size. For example, while previous descriptions have indicated that audio adaptor 100 may include a 3.5 millimeter plug as plug 102 and a 2.5 millimeter jack as jack 104, the principles of the present invention may also be applied to the circumstance where both the plug and jack are the same size but, for example, the plug is a stereo plug having four prongs, while the jack is a monaural jack having only three prongs. In that instance, an audio adaptor can be constructed using wires and/or metal tabs to couple a 3.5 millimeter stereo plug to a 3.5 millimeter monaural jack.

Thus it is seen that methods and apparatus for connecting together two audio components that have different size connectors and/or a different configuration of electrical contacts between them are provided. It is understood that the apparatus and methods shown in the figures discussed above are merely illustrative and that these methods and apparatus may be modified, added or omitted. Those skilled in the art will appreciate that the invention can be practiced by other than the described embodiments, which are presented for purposes of illustration rather than of limitation, and the invention is limited only by the claims which follow.

What is claimed is:

1. An audio adaptor comprising:

an audio plug, having a first diameter, that conducts a first set of signals;

an audio jack, having a second diameter that is different than said first diameter, that conducts a second set of signals different from said first set of signals; and a coupler that electrically and physically couples together said plug and said jack, wherein said plug is a four-prong plug adapted to conduct:

a left channel audio signal on a first prong;

a right channel audio signal on a second prong;

a microphone signal on a third prong; and a ground signal on a fourth prong.

2. The adaptor of claim 1, wherein said first diameter is 3.5 millimeters.

3. The adaptor of claim 1, wherein said second diameter is 2.5 millimeters.

4. The adaptor of claim 1, wherein said jack is a three-prong jack.

5. The adaptor of claim 1, wherein said jack is a three-prong jack adapted to conduct:

an audio signal on a fifth prong;

a microphone signal on a sixth prong; and a ground signal on a seventh prong.

6. The adaptor of claim 5, wherein said coupler comprises:

circuitry that electrically couples a selected one of said first and second prongs to said fifth prong, said third prong to said sixth prong and said fourth prong to said seventh prong.

7. The adaptor of claim 6, wherein said circuitry comprises:

a plurality of conductive metal tabs that are physically attached to said fifth prong and said selected one of said first and second prongs.

8. The adaptor of claim 6, wherein said circuitry comprises:

a plurality of conductive wires that are physically attached to said fifth prong and said selected one of said first and second prongs.

9. The adaptor of claim 1, wherein said coupler comprises:

a material that permanently bonds said plug and said jack into a single physical unit.

10. The adaptor of claim 7, wherein said coupler comprises:

a material that permanently bonds said plug to said jack and also encapsulates said plurality of metal tabs.

11. The adaptor of claim 5, wherein said coupler comprises a first conductor that electrically couples said fifth prong to at least one of said first and second prongs.

12. The adaptor of claim 11, wherein:

said first conductor is physically attached to said fifth prong and said at least one of said first and second prongs; and said first conductor is one of a conductive metal tab and a conductive wire.

13. The adaptor of claim 11, wherein said coupler further comprises:

a second conductor that electrically couples said third prong to said sixth prong; and a third conductor that electrically couples said fourth prong to said seventh prong.

14. The adaptor of claim 11, wherein said coupler further comprises a material that permanently bonds said plug and said jack into a single physical unit.

15. The adaptor of claim 14, wherein said material comprises injection molding material.

16. An audio adaptor comprising:

an audio plug, having a first diameter, that conducts a first set of signals;

an audio jack, having a second diameter that is different than said first diameter, that conducts a second set of signals different from said first set of signals; and a coupler that electrically and physically couples together said plug and said jack, wherein said jack is a three-prong jack adapted to conduct:

an audio signal;

a microphone signal; and a ground signal.

17. An audio adaptor comprising:

a 3.5 millimeter plug having four prongs;

a 2.5 millimeter jack having three prongs; and a coupler that physically couples said plug to said jack, said coupler including circuitry that electrically connects each of said three prongs on said jack to one of said prongs on said plug, wherein said four prongs on said plug comprise:

a first prong that conducts left channel audio signals;

a second prong that conducts right channel audio signals;

a third prong that conducts microphone signals; and a fourth prong that conducts ground signals.

18. The audio adaptor of claim 17, wherein said three prongs of said jack comprise:

a fifth prong that conducts one of left and right audio signals;

a sixth prong that conducts microphone signals; and a seventh prong that conducts ground signals.

19. The audio adaptor of claim 18, wherein said coupler comprises:

circuitry that electrically connects said fifth prong to one of said first and second prongs, said third prong to said sixth prong, and said fourth prong to said seventh prong.

20. The audio adaptor of claim 18, wherein said coupler comprises:

circuitry that electrically connects said fifth prong to said first and second prongs, said third prong to said sixth prong, and said fourth prong to said seventh prong.

21. The audio adaptor of claim 19, wherein said coupler further comprises a material that permanently physically combines said plug and said jack into a single unit.

22. The audio adaptor of claim 19, wherein at least a portion of said circuitry comprises metal tabs.

23. The audio adaptor of claim 19, wherein at least a portion of said circuitry comprises wires.

24. An audio adaptor comprising:

an audio plug, that conducts a first set of signals;

an audio jack, that conducts a second set of signals different from said first set of signals; and a coupler that electrically and physically couples together said plug and said jack, wherein said audio plug is a four-prong plug adapted to conduct:

a left channel audio signal on a first prong;

a right channel audio signal on a second prong;

a microphone signal on a third prong; and a ground signal on a fourth prong.

25. The adaptor of claim 24, wherein said audio plug and said audio jack are of compatible size.

26. The adaptor of claim 24, wherein said audio jack is a three-prong jack.

27. The adaptor of claim 24, wherein said jack is a three-prong jack adapted to conduct:

an audio signal on a fifth prong;

a microphone signal on a sixth prong; and a ground signal on a seventh prong.

28. The adaptor of claim 27, wherein said coupler comprises:

circuitry that electrically couples a selected one of said first and second prongs to said fifth prong, said third prong to said sixth prong and said fourth prong to said seventh prong.

29. The adaptor of claim 28, wherein said circuitry comprises:

a plurality of conductive metal tabs that are physically attached to said fifth prong and said selected one of said first and second prongs.

30. The adaptor of claim 28, wherein said circuitry comprises:

a plurality of conductive wires that are physically attached to said fifth prong and said selected one of said first and second prongs.

31. The adaptor of claim 29, wherein said coupler comprises:

a material that permanently bonds said plug to said jack and also encapsulates said plurality of metal tabs.

32. The adaptor of claim 31, wherein said material comprises:

injection molding material.

33. The adaptor of claim 27, wherein said coupler comprises a first conductor that electrically couples said fifth prong to at least one of said first and second prongs.

34. The adaptor of claim 33, wherein:

said first conductor is physically attached to said fifth prong and said at least one of said first and second prongs; and said first conductor is one of a conductive metal tab and a conductive wire.

35. The adaptor of claim 33, wherein said coupler further comprises:

a second conductor that electrically couples said third prong to said sixth prong; and a third conductor that electrically couples said fourth prong to said seventh prong.

36. The adaptor of claim 33, wherein said coupler further comprises a material that permanently bonds said plug and said jack into a single physical unit.

37. The adaptor of claim 36, wherein said material comprises injection molding material.

38. An audio adaptor comprising:

an audio plug, that conducts a first set of signals;

an audio jack, that conducts a second set of signals different from said first set of signals; and a coupler that electrically and physically couples together said plug and said jack, wherein said audio jack is a three-prong jack adapted to conduct:

an audio signal;

a microphone signal; and a ground signal.

39. An audio adaptor comprising:

an audio plug, that conducts a first set of signals;

an audio jack, that conducts a second set of signals different from said first set of signals; and a coupler that electrically and physically couples together said plug and said jack, wherein said coupler comprises:

a material that permanently bonds said plug and said jack into a single physical unit.

40. The adaptor of claim 39, wherein said material comprises injection molding material.

41. The adaptor of claim 39, wherein said audio plug and said audio jack are of compatible size.

42. The adaptor of claim 39, wherein said audio plug is a four-prong plug.

43. The adaptor of claim 39, wherein said audio jack is a three-prong jack.

44. The adaptor of claim 39, wherein:

said audio plug is a 3.5 millimeter plug having four prongs; and said audio jack is a 2.5 millimeter jack having three prongs.

* * * * *